US009701375B2

(12) United States Patent
Kang et al.

(10) Patent No.: US 9,701,375 B2
(45) Date of Patent: Jul. 11, 2017

(54) SYSTEM FOR PREVENTING INUNDATION AND SHIP HAVING THE SAME

(71) Applicant: Korea Institute of Ocean Science & Technology, Ansan (KR)

(72) Inventors: Hee-Jin Kang, Gyeryong (KR); Jin Choi, Gyeryong (KR); Dong-Kon Lee, Daejeon (KR)

(73) Assignee: KOREA INSTITUTE OF OCEAN SCIENCE & TECHNOLOGY, Ansan (KR)

( * ) Notice: Subject to any disclaimer, the term of this patent is extended or adjusted under 35 U.S.C. 154(b) by 0 days.

(21) Appl. No.: 15/081,541

(22) Filed: Mar. 25, 2016

(65) Prior Publication Data

US 2017/0096201 A1 Apr. 6, 2017

(30) Foreign Application Priority Data

Oct. 5, 2015 (KR) ..... 10-2015-0139624

(51) Int. Cl.

| | |
|---|---|
| ***B63B 43/12*** | (2006.01) |
| ***B63B 43/14*** | (2006.01) |
| ***A62C 3/10*** | (2006.01) |
| ***B63B 39/00*** | (2006.01) |

(52) U.S. Cl.

CPC ..... *B63B 43/12* (2013.01); *A62C 3/10* (2013.01); *B63B 39/00* (2013.01); *B63B 43/14* (2013.01); *B63B 2043/126* (2013.01)

(58) Field of Classification Search

CPC ..... B63B 43/00; B63B 43/02; B63B 43/12; B63B 43/14; B63B 39/00; A62C 3/10

USPC ..... 114/68, 221 R, 360

See application file for complete search history.

(56) References Cited

U.S. PATENT DOCUMENTS

| | | | | | |
|---|---|---|---|---|---|
| 644,480 | A | * | 2/1900 | De Villa | B63B 43/14 114/68 |
| 1,320,012 | A | * | 10/1919 | Lee | B63B 43/14 114/68 |
| 2,403,806 | A | * | 7/1946 | Langdon | B63B 43/12 114/68 |
| 2,966,131 | A | * | 12/1960 | Elijah | B63B 19/12 114/68 |
| 4,458,618 | A | * | 7/1984 | Tuffier | B63B 43/12 114/360 |

* cited by examiner

*Primary Examiner* — Lars A Olson

(57) ABSTRACT

An inundation prevention system for ship is provided. The inundation prevention system for ship includes a fire-extinction gas ejection part configured to eject a fire extinction gas to an installation area prepared in a hull, an airbag part of 3D shape disposed in the installation area, and an airbag actuation part configured to supply the fire extinction gas to the airbag part, if inundation occurs in the installation are, and to inflate the airbag in the installation for compulsory buoyancy.

7 Claims, 6 Drawing Sheets

【Fig. 1】
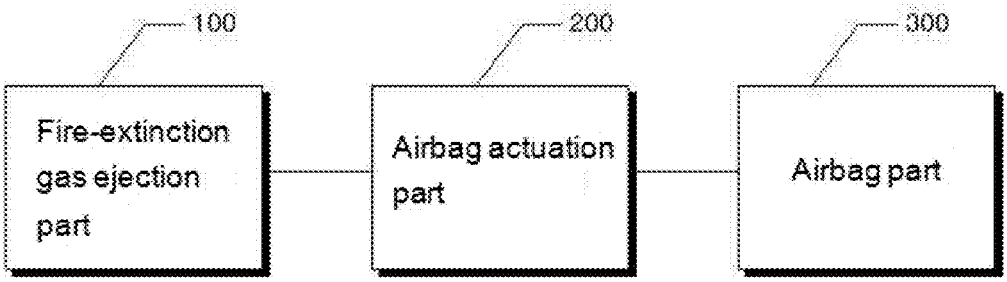

【Fig. 2】
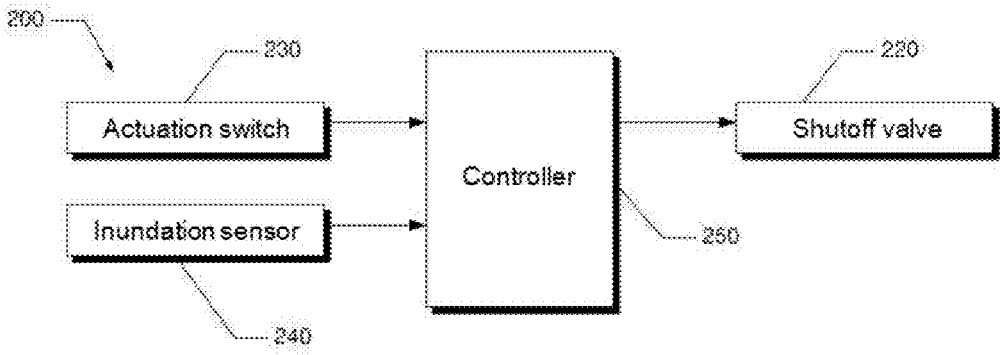

【Fig. 3】
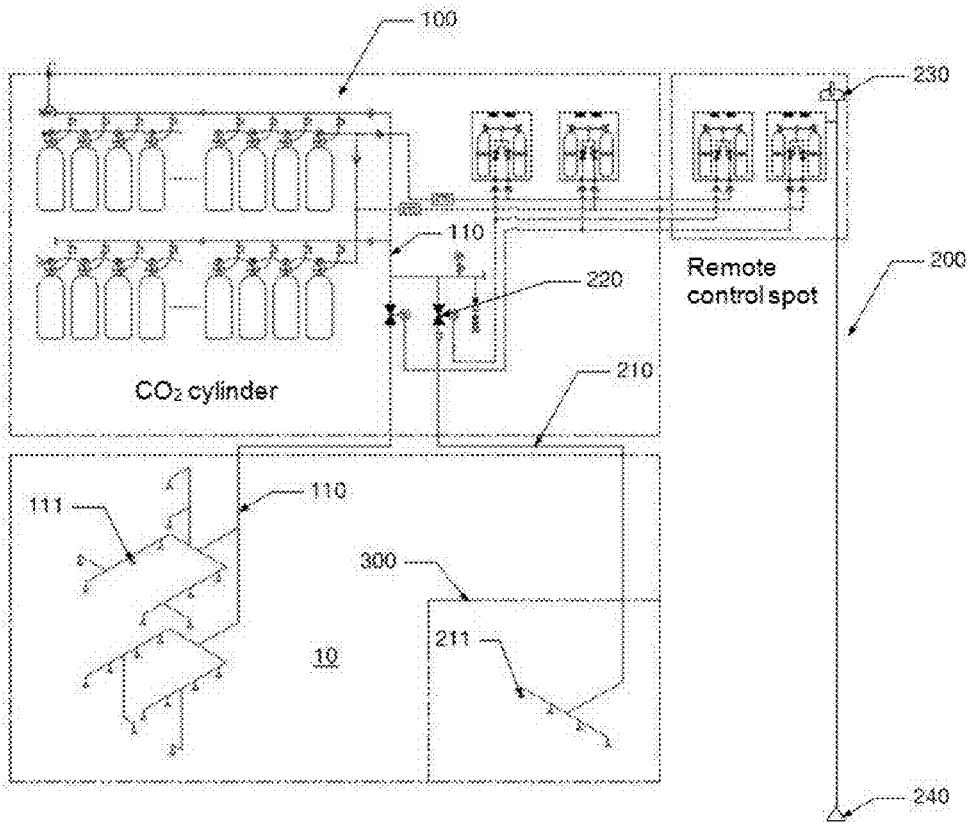

【Fig. 4】
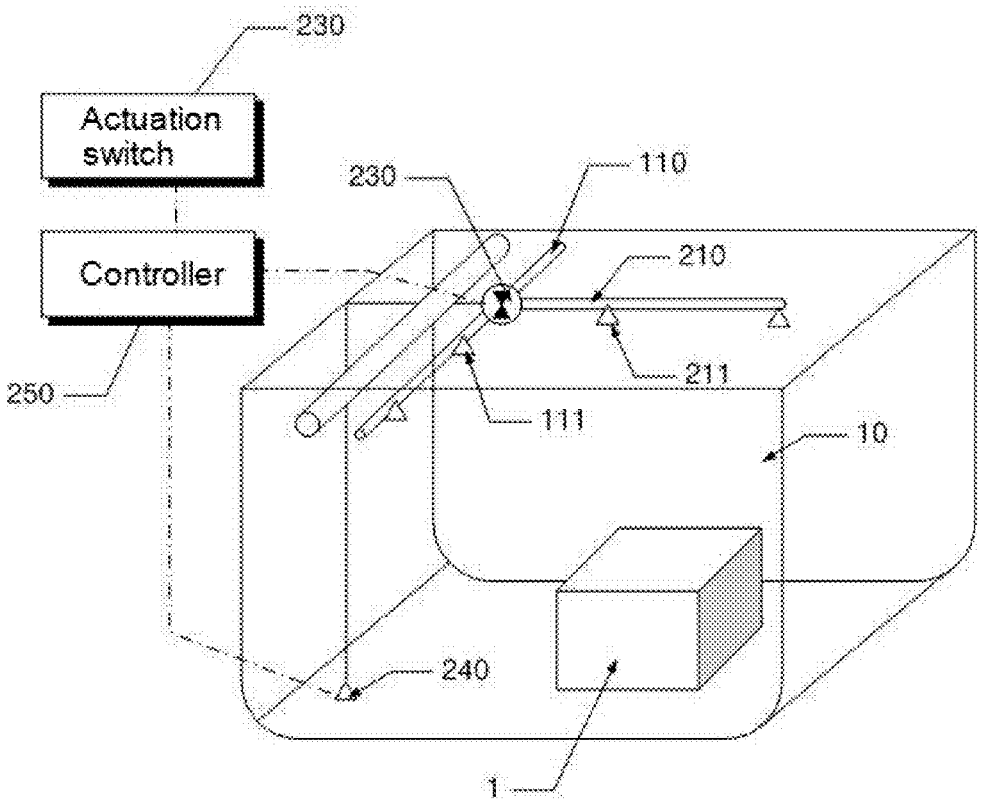

【Fig. 5】
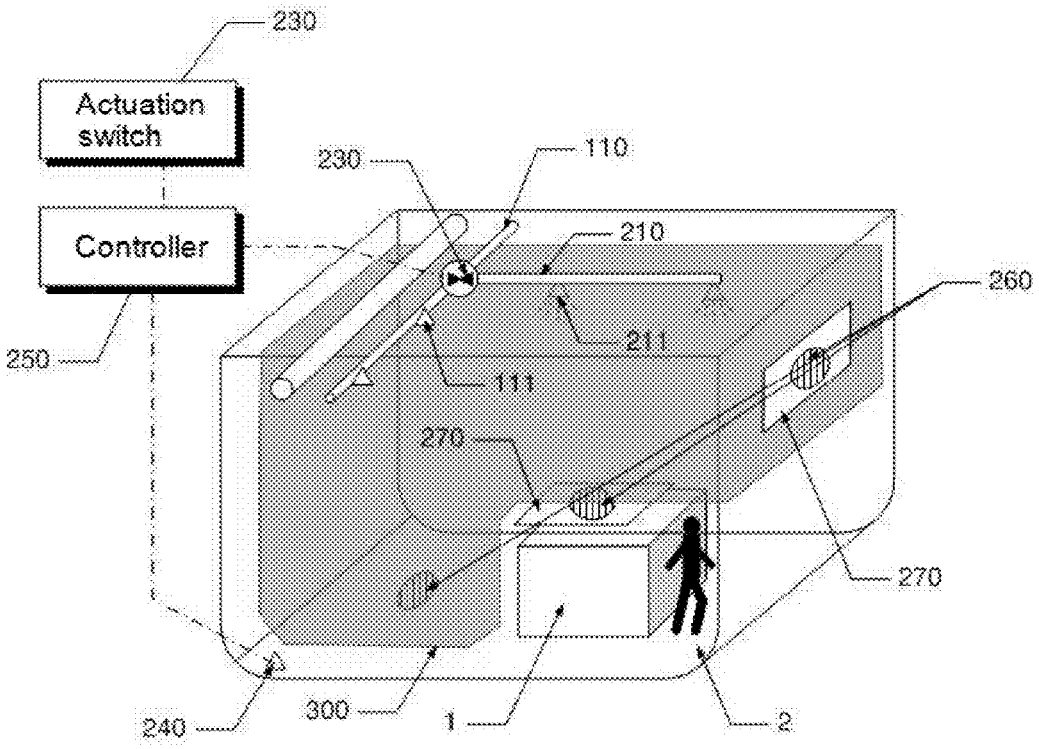

[Fig. 6]
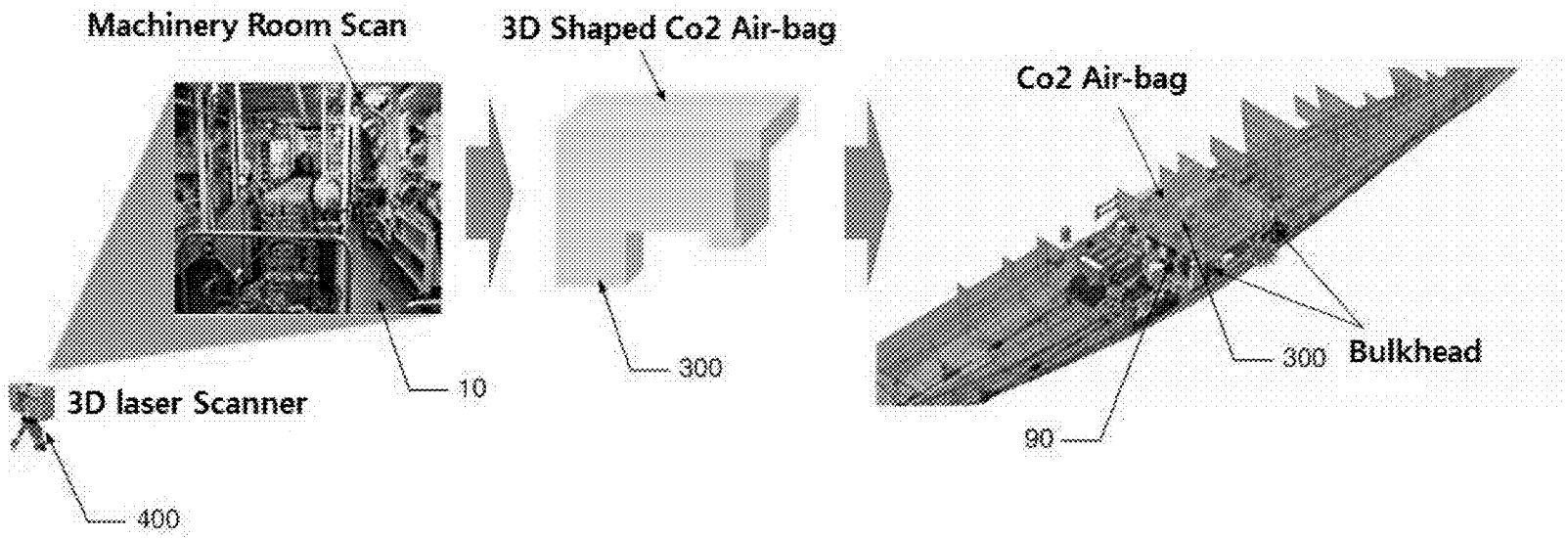

SYSTEM FOR PREVENTING INUNDATION AND SHIP HAVING THE SAME

CROSS-REFERENCE TO RELATED APPLICATION(S)

This application claims the benefit under 35 U.S.C. §119 (a) of a Korean patent application filed on Oct. 5, 2015 in the Korean Intellectual Property Office and assigned Serial number 10-2015-0139624, the entire disclosure of which is hereby incorporated by reference.

TECHNICAL FIELD

The present disclosure relates to an inundation prevention system and more particularly, to an inundation prevention system, and a ship having the system, capable of preventing the ship from inundation and submergence by readily injecting a fire extinguish gas into a 3D airbag and thereby inflating the airbag in the emergency that the ship is about to be inundated.

BACKGROUND

For various types of accidents occurring in marine environments, ships are usually equipped with safety facilities and apparatuses which are required by the classification society rules and Safety Of Life At Sea (SOLAS).

Even with the preparation, there are still many accidents such as overturns or submergence, due to crashes or grounding, in the sea and damages of human lives, environments and property in the situation of hardly utilizing essential sailing equipment.

In a general case that there is inundation by a damage due to an overturn or grounding, a waterproofing work is performed to close inundated areas, for obstruct further inundation, by filling up broken parts or by utilizing watertight doors and partitions.

Under the areal closure, inundation at closed areas causes a trim and a heeling of a ship and eventually results in a serious list which disables operations of principal sailing equipment such as navigation radars or power generators.

Therefore, in the case that inundated areas of a ship are overrun beyond a controllable range of safety or watertight doors are out of order, unstable marine conditions gradually aggravates the disaster to deepen inundation, eventually causing the ship to be overturned or submerged.

SUMMARY

Aspects of the present disclosure are to address at least the above-mentioned problems and/or disadvantages and to provide at least the advantages described below. Accordingly, an aspect of the present disclosure is to provide an inundation prevention system for ship, and a ship having the system, capable of promptly injecting carbon oxide ($CO_2$) gas, which is prepared for fire extinction in the ship, into a 3D airbag if inundation is detected in the ship.

Another aspect of the present disclosure is to provide an inundation prevention system for ship, and a ship having the system, without additional gas injection facility for 3D airbag inflation by using carbon oxide ($CO_2$) gas, which is prepared for fire extinction in the ship, for inflating the 3D airbag.

Still another aspect of the present disclosure is to provide an inundation prevention system for ship, and a ship having the system, capable of allowing 3D-airbag inflation to be remotely controlled from a bridge or inundation control spot and activating an automatic airbag operation in the case that there is no airbag operation even while inundation is overrun beyond a specific level.

Further still another aspect of the present disclosure is to provide an inundation prevention system for ship, and a ship having the system, capable of using 3D scan information for an airbag installation area and, after recognizing a shape of the airbag installation area, preparing and installing an airbag in the hull of the ship not to be damaged by other structures of the installation area.

According to an embodiment of the present disclosure, an inundation prevention system for a ship may be provided. The inundation prevention system may include a fire-extinction gas ejection part configured to eject a fire extinction gas to an installation area prepared in a hull; an airbag part of 3D shape disposed in the installation area; and an airbag actuation part configured to supply the fire extinction gas to the airbag part, if inundation occurs in the installation are, and to inflate the airbag in the installation for compulsory buoyancy.

The airbag part may be formed corresponding to a 3D shape of the installation are.

The installation area may include an equipment installation area including a multiplicity of facilities, and a passage area forming a move and escape path, and the airbag may be formed in a 3D shape distant from the equipment installation area and passage area in a specific interval.

The airbag part may be connected with a wall of the installation area through a multiplicity of joints.

The joint may include a protection plate to physically protect the airbag part.

The airbag actuation part may include: a gas injection tube exposed to the installation area, connected with the airbag part, connected with the fire-extinction gas ejection part to form a flow line of the fire extinction gas, and equipped with a multiplicity of gas injection nozzles injecting the fire extinction gas into the airbag part; a shutoff valve installed at the gas injection tube and configured to open and close the flow line of the fire extinction gas; an actuation switch configured to open and close the shutoff valve; and a controller configured to receive a shutoff signal from the actuation switch, to drive the shutoff valve, compulsorily to inject the fire extinction gas into the airbag part connected with the gas injection part, and to inflate the airbag part.

The installation area may include an inundation sensor configured to detect inundation in the installation area.

The controller may receive a signal of inundation detection from the actuation switch, drive the shutoff valve, compulsorily inject the fire extinction gas into the airbag part connected with the gas injection part, and inflate the airbag part.

The shutoff valve may include a receiver and the controller may include a transmitter.

The controller remotely may control the shutoff valve by wirelessly transmit a drive signal to the shutoff valve through the transmitter in a specific frequency band.

The airbag part may use a 3D scanner to obtain 3D scan information for the installation area, and may be fabricated by forming a body of the airbag part in correspondence with the obtained 3D scan information.

The airbag part may be formed of nylon or Kevlar that is waterproof and endurable.

According to another embodiment of the present disclosure, a ship including the inundation prevention system may be provided.

Other aspects, advantages, and salient features of the disclosure will become apparent to those skilled in the art from the following detailed description, which discloses various embodiments of the present disclosure in conjunction with the annexed drawings.

BRIEF DESCRIPTION OF THE DRAWINGS

The above and other aspects, features, and advantages of certain embodiments of the present disclosure will be more apparent from the following description taken in conjunction with the accompanying drawings, in which:

FIG. 1 is a schematic diagram illustrating a configuration of an inundation prevention system for ship according to embodiments of the present disclosure;

FIG. 2 is a block diagram illustrating a configuration of an airbag actuation part according to embodiments of the present disclosure;

FIG. 3 is a pipeline diagram illustrating a configuration of an inundation prevention system for ship;

FIG. 4 is a schematic diagram illustrating a state before inflation of an airbag part according to embodiments of the present disclosure;

FIG. 5 is a schematic diagram illustrating a state after inflation of an airbag part according to embodiments of the present disclosure; and FIG. 6 is a diagram illustrating a process of fabricating an airbag part according to embodiments of the present disclosure.

Throughout the drawings, it should be noted that like reference numbers are used to depict the same or similar elements, features, and structures.

DETAILED DESCRIPTION

Hereinafter, an inundation prevention system and a ship using the system will be described in conjunction with the accompanying drawings.

Referring to FIGS. 1 to 4, a ship according to embodiments of the present disclosure may be prepared with a multiplicity of cabins or partitions.

The cabins or partitions may form an installation area 10 in which an airbag part 300 can be installed.

As shown in FIG. 5, the installation area 10 may include an equipment installation area 1, and a passage area 2 forming a move or escape path.

The equipment may be a device such as power generator, including all other units in the installation area 10.

The passage area 2 may be an area for allowing worker to move or escape.

An inundation prevention system according to embodiments of the present disclosure may be installed in the ship.

An inundation prevention system for ship may be roughly formed of a fire-extinction gas ejection part 100, the airbag part 300, and an airbag actuation part 200.

The fire-extinction gas ejection part 100 may be a main fire-extinction tube 110 capable of supplying carbon oxide ($CO_2$) to the installation area from a $CO_2$ cylinder, and a multiplicity of $CO_2$ ejection nozzles 111 prepared at a plurality of locations and ejecting the supplied $CO_2$ to the installation area.

The carbon oxide is gas for fire extinction in the case that fire occurs in the installation area 10.

The installation area 10 may include the airbag part 300 according to embodiments of the present disclosure.

The airbag part 300 may have a waterproof function and may be formed in a 3D shape corresponding to a pattern of the installation area.

It may be preferred to set the airbag part 300 in a specific interval from the equipment installation area 1 and the passage area 2 which are provided in the installation area 10.

This configuration is directed to prevent the airbag part 300 from physical damages by making the airbag part 300 not in direct contact with the equipment installation area 1 and the passage area 2.

The airbag part 300 may be formed of nylon or kevlar which has highly waterproof and endurable.

The airbag part 300 according to the present disclosure may not be restrictive hereto in material.

In the meantime, as shown in FIG. 5, a multiplicity of joint parts 260 is provided on the wall of the installation area 10.

At the joint parts 260, protection plates 270 may be installed to physically protect the airbag part 300.

Now a configuration of the airbag actuation part 200 will be described below.

The airbag control according to embodiments of the present disclosure may be formed of a gas injection tube 210, a shutoff valve 220, an actuation switch 230, and a controller 250.

The actuation switch 220 may be installed in a remote control spot.

The gas injection tube 210 may be exposed to the installation area 10 and may be connected with the airbag part 300.

The gas injection tube 210 may be branched out from the man fire-extinction tube 110.

The gas injection tube 210 may thereby form a flow line of carbon oxide which is used as a fire extinction gas.

At a multiplicity of positions for the gas injection tube 210, a multiplicity of gas injection nozzles 211 may be installed to supply carbon oxide into the airbag part 300.

The shutoff valve 220, as a kind of electronic valve, may be installed on the gas injection tube to open and close a flow line of carbon oxide.

The actuation switch 230 may be connected with the controller 250 and may transfer a signal to the controller 250 to execute a shutoff operation of the actuation switch 230.

The controller 250 may receive a shutoff signal from the actuation switch 230 to drive the shutoff valve 220, and may force the fire extinction gas to be injected into the airbag part 300, which is connected with the gas injection tube 210, to inflate the airbag part 300.

Hereupon, the shutoff valve 220 may be a remote valve.

For example, the shutoff valve 220 may include a receiver (not shown) and the controller 250 may include a transmitter (not shown).

Accordingly, the controller 250 may remotely control the shutoff valve 220 by wirelessly transmitting a drive signal to the shutoff valve 220 through the transmitter in a specific frequency band.

Therefore, by disposing the actuation switch 230 in or out of the installation area 10, it may be possible to adjust an inflation rate of the airbag part 300 in a spot distant from an inundated area.

Additionally, in the installation area 10 according to embodiments of the present disclosure, an inundation sensor 240 may be provided to detect inundation of the installation area 10.

Accordingly, the controller 250 may receive a signal from the inundation sensor 240 to drive the shutoff valve 220 and then may compulsorily inject the fire extinction gas into the airbag part 300, which is connected with the gas injection tube 210, to inflate the airbag part 300.

The actuation switch 230 and the inundation sensor 240 may be electrically cooperated each other.

With this configuration, in the case that the airbag part 300 does not inflate after a worker drives the actuation switch since inundation of the installation area 10, the controller 250 may receive an inundation signal from the inundation sensor 250 and then may drive the shutoff valve 220 to be compulsorily open to promptly inflate the airbag part 300.

On the other hand, referring to FIG. 6, the airbag part 300 may employ a 3D scanner 400 to obtain 3D scan information about the installation area 10.

And then, a body of the airbag part 300 may be formed to match with the obtained 3D scan information.

The airbag part 300 may be disposed in the installation area 10 of a hull 90.

Accordingly, the airbag part 300 having a 3D shape according to embodiments of the present disclosure may allow an entry and passage spaces of workers to be secured without contacts with principal facilities, equipment, and brackets in the installation area 10 when the airbag part 300 is inflating.

According to embodiment of the present disclosure, it may be accomplishable to prevent a ship from submergence by promptly injecting carbon oxide ($CO_2$) gas, which is prepared for fire extinction in the ship, into a 3D airbag if inundation is detected in the ship.

Additionally, it may be permissible to provide convenience of installation without additional gas injection facility for 3D airbag inflation by using carbon oxide ($CO_2$) gas, which is prepared for fire extinction in the ship, for inflating the 3D airbag.

Additionally, it may be allowable for 3D-airbag inflation to be remotely controlled from a bridge or inundation control spot in need of actuating the airbag part, and may be allowable for the actuation switch and the inundation sensor to cooperate each other to enable an automatic airbag operation in the case that there is no airbag operation even while inundation is overrun beyond a specific level, providing operational security.

Additionally, it may be capable of using 3D scan information for an airbag installation area and, after recognizing a shape of the airbag installation area, preparing and installing an airbag in the hull of the ship not to be damaged by other structures of the installation area.

Additionally, it may be effective in securing an entry/exit and escape path for waterproof workers by installing an airbag, which is folded in a normal state, at the top end of the installation area not to be damaged from steep edges of equipment, facility and brackets when the airbag is inflating.

Additionally, it may be permissible to provide an entry and escape space of workers, without contacts with principal facility, equipment, and brackets in the area while a 3D airbag is inflating, by recognizing a shape of the installation area through a 3D laser scanner to confirm whether the 3D air bag is in contact with steep edges, equipment, and facility, and to confirm the probability of securing an entry/exit and escape path of waterproof workers and then by fabricating and installing the 3D air bag in the installation area.

While embodiments of the present disclosure have been shown and described with reference to the accompanying drawings thereof, it will be understood by those skilled in the art that various changes and modifications in form and details may be made therein without departing from the spirit and scope of the present disclosure as defined by the appended claims and their equivalents. For example, it may be allowable to achieve desired results although the embodiments of the present disclosure are preformed in other sequences different from the descriptions, and/or the elements, such as system, structure, device, circuit, and so on, are combined or assembled in other ways different from the descriptions, replaced or substituted with other elements or their equivalents. Therefore, other implementations, other embodiments, and equivalents of the appended claims may be included in the scope of the appended claims.

What is claimed is:

1. An inundation prevention system for a ship, the inundation prevention system comprising:

a fire-extinction gas ejection part configured to eject a fire extinction gas to an installation area disposed in a hull;

an airbag part having a three-dimensional (3D) shape, the airbag part being disposed in the installation area; and an airbag actuation part configured to supply the fire extinction gas to the airbag part, if inundation occurs in the installation area, and to inflate the airbag in the installation for producing compulsory buoyancy, wherein the airbag actuation part comprises:

a gas injection tube exposed to the installation area, connected with the airbag part, connected with the fire-extinction gas ejection part to form a flow line of the fire extinction gas, and equipped with a multiplicity of gas injection nozzles injecting the fire extinction gas into the airbag part;

a shutoff valve installed at the gas injection tube and configured to open or close the flow line of the fire extinction gas;

an actuation switch configured to open or close the shutoff valve; and a controller configured to receive a shutoff signal from the actuation switch, to drive the shutoff valve, to compulsorily inject the fire extinction gas into the airbag part connected with the gas injection tube, and to inflate the airbag part.

2. The inundation prevention system of claim 1, the 3D shape of the airbag part corresponds to a 3D shape of the installation area.

3. The inundation prevention system of claim 2, wherein the installation area comprises an equipment installation area including a multiplicity of facilities, and a passage area forming a move and escape path, and wherein the airbag part has the 3D shape that is spaced apart from the equipment installation area and the passage area by a specific interval.

4. The inundation prevention system of claim 2, wherein the airbag part is connected with a wall of the installation area through a multiplicity of joints, and wherein each of the joints includes a protection plate to physically protect the airbag part.

5. The inundation prevention system of claim 1, wherein an inundation sensor is disposed in the installation area and is configured to detect inundation in the installation area, wherein the actuation switch is cooperated with the inundation sensor, and wherein the controller is configured to receive a signal indicative of inundation detection from the actuation switch, to drive the shutoff valve, to compulsorily inject the fire extinction gas into the airbag part connected with the gas injection tube, and to inflate the airbag part.

6. The inundation prevention system of claim 1, wherein the shutoff valve comprises a receiver, wherein the controller comprises a transmitter, and wherein the controller remotely controls the shutoff valve by wirelessly transmitting a drive signal to the shutoff valve through the transmitter in a specific frequency band.

7. The inundation prevention system of claim 1, wherein the airbag part uses a 3D scanner to obtain 3D scan information for the installation area, wherein the airbag part is fabricated by forming a body of the airbag part in correspondence with the obtained 3D scan information, and wherein the airbag part is formed of nylon that is waterproof and endurable.

* * * * *